United States Patent [19]

Shopalovich

[11] 4,130,917

[45] Dec. 26, 1978

[54] FLEXIBLE SLIDE FASTENER

[75] Inventor: Predrag Shopalovich, Ashland, Mass.

[73] Assignee: The United States of America as represented by the Secretary of the Army, Washington, D.C.

[21] Appl. No.: 869,548

[22] Filed: Jan. 16, 1978

[51] Int. Cl.[2] ..... A44B 19/32; A44B 19/02

[52] U.S. Cl. .....24/205.1 R; 24/205.11 R; 24/205.14 R; 24/205 R

[58] Field of Search ..... 24/205 R, 205.12, 205.1 R

[56] References Cited

U.S. PATENT DOCUMENTS

| | | | |
|---|---|---|---|
| 1,719,856 | 7/1929 | Sipe | 24/205 R |
| 1,746,565 | 2/1930 | Sundback | 24/205.12 |
| 1,785,234 | 12/1930 | Sundback | 24/205 R |
| 1,809,717 | 6/1931 | Sundback | 24/205.12 |
| 1,893,379 | 1/1933 | Sundback | 24/205 R |
| 1,960,010 | 5/1934 | Hopkinson | 24/205 R |
| 2,115,424 | 4/1938 | Lesti | 24/205 R |
| 2,397,801 | 4/1946 | Mitchell | 24/205.13 D |
| 3,423,802 | 1/1969 | Hytonen | 24/205.12 |

*Primary Examiner*—Bernard A. Gelak

*Attorney, Agent, or Firm*—Nathan Edelberg; Robert P. Gibson; Charles C. Rainey

[57] ABSTRACT

A slide fastener including a first elongated guide member with a longitudinally extending closure edge that is incrementally forced into intimate engagement with a longitudinally extending mating edge of a second elongated guide member in response to movement of a slide member. Opposite longitudinal edges of the guide members are adapted for attachment to the edges of flexible sheets of material that are to be joined. Distributed along the mating edge are a plurality of removable male coupling elements that enter and latch with female coupling elements distributed along the closure edge in response to movement of the slide member. The coupling elements comprise resilient latching portions formed by spaced apart resilient spring legs that are compressed by the female elements during entry thereinto and expand into latching engagement therewith after complete entry. Preferably, the female elements define openings that have smaller dimensions than the spacing between the resilient legs of the latching portions.

4 Claims, 7 Drawing Figures

FLEXIBLE SLIDE FASTENER

ORIGIN OF THE INVENTION

The invention described herein may be manufactured, used and licensed by or for the Government for governmental purposes without the payment to me of any royalty thereon.

BACKGROUND OF THE INVENTION

This invention relates generally to slide fasteners and, more particularly, to slide fasteners for joining large sections of flexible sheet material.

Slide fasteners such as the familiar zipper are used extensively to join sections of flexible sheet material in a wide variety of applications. One such application entails the joining of modular, tent units to provide composite shelters of desired size and configuration. Although quite useful when quick, temporary shelter is required, such composite structures exhibit various deficiencies directly associated with the zippers used to join the discrete units. For example, if foreign materials become wedged between teeth during a zipping operation or if individual teeth are damaged or lost, a zipper becomes inoperable. Also, the repair of damaged zippers often is impractical and in any case requires special tools. Another significant deficiency of the common zipper is its failure to create liquid tight seals which results in shelters that are not completely weatherproof.

The object of this invention, therefore, is to provide an improved fastener for joining sections of flexible sheet material and, more specifically, a slide fastener for joining modular tent units into composite structures of a desired shape and size.

SUMMARY OF THE INVENTION

The invention is a slide fastener including a first elongated guide member with a longitudinally extending closure edge that is incrementally forced into intimate engagement with a longitudinally extending mating edge of a second elongated guide member in response to movement of a slide member. Opposite longitudinal edges of the guide members are adapted for attachment to the edges of flexible sheets of material that are to be joined. Distributed along the mating edge are a plurality of removable male coupling elements that enter and latch with female coupling elements distributed along the closure edge in response to movement of the slide member. The male coupling elements comprise resilient latching portions formed by spaced apart resilient spring legs that are compressed by the female elements during entry thereinto and expand into latching engagement therewith after complete entry. Preferably, the female elements define openings that have smaller dimensions than the spacing between the resilient legs of the latching portions. Repair of the fastener is facilitated by the discrete male coupling elements which can be individually replaced and the intimately engaged closure and mating edges form a liquid tight seal.

In a preferred embodiment of the invention, opening of the fastener is aided by an actuator that compresses the resilient latching portions of the male coupling elements during sliding movement of the slide member along the guide members. The actuator releases the male coupling elements allowing separation of the guide members. To facilitate reclosure of the fastener an operator is provided for rendering the actuator inoperative to compress the latching portions.

DESCRIPTION OF THE DRAWINGS

These and other objects and features of the present invention will become more apparent upon a perusal of the following description taken in conjunction with the accompanying drawings wherein:

FIG. 4 is a cross-sectional view of the slide member shown in FIG. 3 taken along the lines 5—5;

DESCRIPTION OF THE PREFERRED EMBODIMENTS

Figure 1:
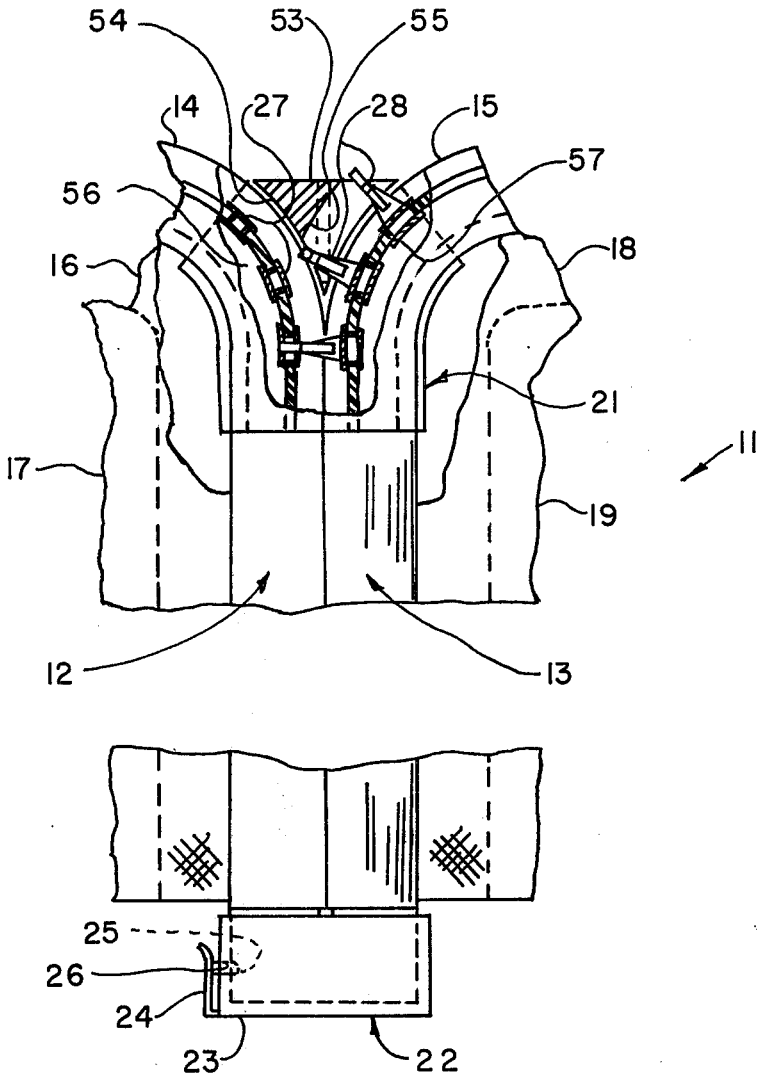
FIG. 1 is a partially cutaway schematic view of a preferred slide fastener according to the invention.
Figure 2:
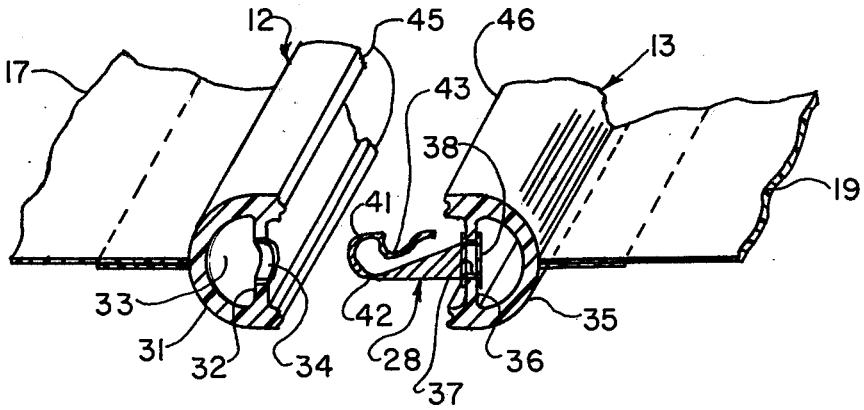
FIG. 2 is a cross-sectional perspective view of engaging guide members of the slide fastener shown in FIG. 1.

Referring to FIGS. 1 and 2 there is shown a slide fastener 11 constructed in accordance with the invention. Forming the slide fastener 11 is a pair of elongated guide members 12 and 13 made of flexible material such as plastic, rubber, etc. The guide member 12 includes a longitudinally extending closure edge 14 that is adapted to physically engage a longitudinally extending mating edge 15 of the guide member 13. An opposite longitudinally extending edge 16 of the guide member 12 is attached, for example by stitching or cementing, to a piece of flexible sheet material 17. Similarly, an opposite longitudinally extending edge 18 of the guide member 13 is attached to a piece of sheet material 19 that is to be joined to the sheet material 17. A slide member 21, described more fully hereinafter, simultaneously engages the guide members 12 and 13 and incrementally forces directly adjacent portions of the closure and mating edges 14 and 15 together as it slides longitudinally therealong. Secured to one end of the guide member 13 is a terminal member 22 that defines an enclosure 23 for receiving an end of the guide member 12. A resilient spring catch 24 has one end fixed to the bottom of the enclosure 23. The other end of the catch 24 is free and comprises a nipple 25 that is biased through an aperture 26 in the enclosure 23 so as to engage the received end of the guide member 12.

Longitudinally distributed along the closure edge 14 are a plurality of female coupling elements 27. Similarly distributed along the mating edge 15 are a plurality of male coupling elements 28 aligned with the female elements 27. In response to sliding movement of the slide member 21 along the guide members 12 and 13, the male elements 28 sequentially enter directly. adjacent female elements 27 and become latched therein. In this way the guide members 12 and 13 become securely attached along the closure and mating edges 14 and 15 to join the sheet material pieces 17 and 19.

As shown most clearly in FIG. 2, the guide member 12 comprises an elongated concave channel 31 having inner surfaces joined by a transverse web 32. Defined by the channel 31 and the web 32 is an elongated cavity 33 that extends along the entire length of the guide member 12. A plurality of openings 34 are spaced longitudinally along the web 32 and communicate with the cavity 33. Together the openings 34 and the cavity 33 form the female coupling elements 27. The guide member 13 similarly includes an elongated concave channel 35 having inner surfaces joined by a web 36. Extending through the web 36 are longitudinally spaced openings 37 that align with the openings 34 in the web 32 of the guide member 12. Secured into each of the openings 37 is a grommet type base portion 38 of one of the male coupling elements 28. Extending from the base portions 38 of the male coupling elements 28 are latching portions formed by spaced apart legs 41 and 42 formed of a suitable resilient spring material. The dimensions of the openings 34 in the guide member 12 are smaller than the normal separation of the legs 41 and 42. Thus, in response to forcible engagement between the guide members 12 and 13, the resilient legs 41 and 42 are compressed during entry into the adjacent openings 34 and thereby create a holding force between the female coupling elements 27 and the male coupling elements 28. A more secure engagement between these elements is established by the provision in the legs 41 of recesses 43 that allow the legs 41 and 42 to expand after complete entry into the cavities 33. With that expansion the peripheral edges of the web 32 defining the openings 34 enter the recesses 43 to latch the male coupling elements 28 with the female elements 27. The arrangement and spacing of the coupling elements 27 and 28 produce intimate contact of engaging surfaces 45 and 46 of the guide members 12 and 13 along their entire lengths. Preferably, the guide members are formed of a suitable resilient material that establishes a liquid tight seal between the surfaces 45 and 46. To improve that seal the longitudinal edge surfaces 45 and 46 are profiled. Thus, upon latching engagement between the aligned female coupling elements 27 and the male coupling elements 28, the complementary surfaces 45 and 46 create nonplanar liquid tight seals.

Figure 3:
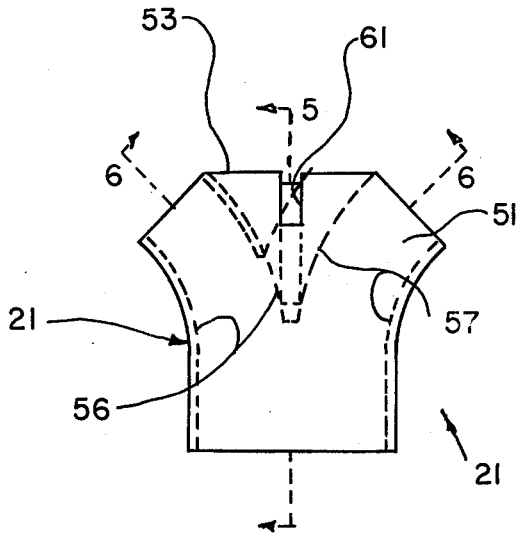
FIG. 3 is a front view of a slide member of the slide fastener shown in FIG. 1.
Figure 6:
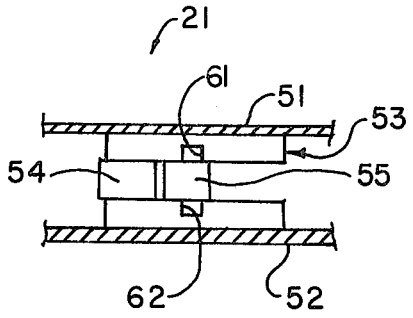
FIG. 6 is a cross-sectional view of the slide member shown in FIG. 3 taken along the lines 6—6.
Figure 4:
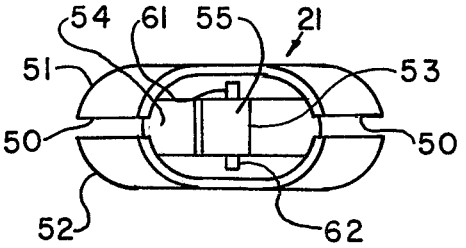
FIG. 4 is an end view of the slide member shown in FIG. 3.

Referring now to FIGS. 3–6 there is shown in greater detail the slide member 21. Forming the slide member 21 is a pair of mating curved shells 51 and 52 separated by diametrically opposite spaces 50 and joined at one end by a connector portion 53. The outer surfaces of the curved shells 51 and 52 are tapered, as shown in FIG. 3, and define with curved surfaces 54 and 55 on the connecting portion 53 converging channels 56 and 57. The inner surfaces of the converging channels 56 and 57 conform to the outer surfaces of the guide members 12 and 13. Thus, as the member 21 slides longitudinally over the guide members 12 and 13 the converging channels 56 and 57 force adjacent portions of the surfaces 45 and 46 into intimate contact and that contact is maintained by the latching action produced by the penetration of the female coupling elements 27 by the male coupling elements 28.

Figure 5:
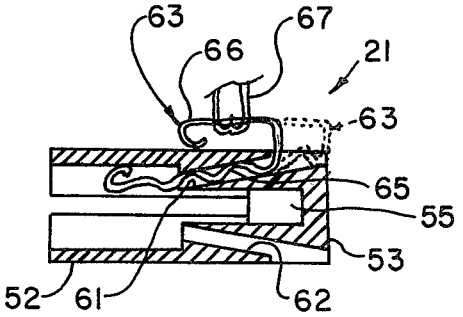

As shown in FIG. 5, a pair of passages 61 and 62 is formed in the connector portion 53 of the slide member 21. The passages extend between the outer surfaces of the shells 51 and 52 and the interior area of the slide member 21 in which the channels 56 and 57 converge. Received by one of the passages 61 is a spring member 63 that includes an actuator portion 64, an intermediate portion 65 and an operator portion 66. The intermediate portion 65 engages the walls of the passage 61 to maintain the member 63 in a desired position. With the spring member 63 positioned as shown in FIG. 5, the actuator portion 64 extends into a region that is successively occupied by the male coupling elements 28 during the unfastening movement of the slide member 21 over the guide member 12 and 13. Thus, in response to such unfastening movement, the actuator portion 64 successively engages and compresses the legs 41 and 42 of each male coupling element 28 permitting withdrawal thereof from the associated female element 27. In this way, the guide members 12 and 13 are separated and the fastener 11 opened. Movement of the slide member 21 along the guide members 12 and 13 can be effected by pulling on a cord 67 attached to the operator portion 66. Reclosure of the fastener is accomplished by grasping the operator portion 66 and moving the spring member into the position shown by dotted lines in FIG. 5. In that position, the actuator portion 64 fails to engage the male elements 28 during movement of the slide. Thus, the above-described latching action between the male and female coupling elements is effected during movement of the slide member along the guide members 12 and 13.

Figure 7:
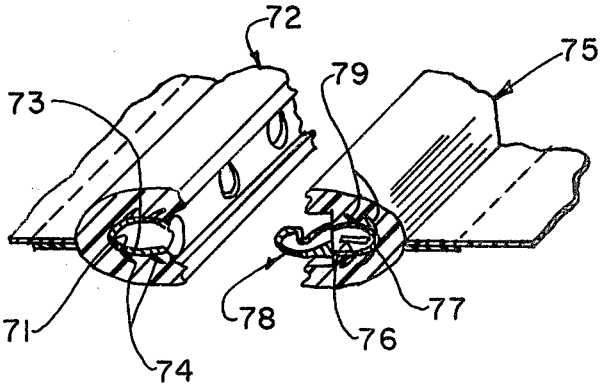
FIG. 7 is a perspective, cross-sectional view of another guide member embodiment of the invention.

FIG. 7 illustrates another invention embodiment that employs modified coupling elements. In this embodiment discrete cavities 71 are formed along the entire length of a guide member 72. Received by each of the cavities 71 is a hollow insert 73 that serves as a female coupling element. Extending out of the inserts 73 are barbs 74 that penetrate the surfaces of the cavities 71 and thereby securely retain the inserts in place. In a similar manner on elongated guide 75 defines a plurality of discrete longitudinally spaced apart cavities 76. Received by and conforming in shape to the cavities 76 are base portions 77 of male coupling elements 78. The base portions 77 also possess barbs 79 that penetrate the surfaces of the cavities 76 and retain the coupling elements 78 in position. In addition a suitable cement can be used to secure the base portions 77 and inserts 73. Replacement of individual coupling elements is easily accomplished by gripping either the inserts 73 or the elements 78 with a tool such as a pair of pliers and removing from the cavities 71 or 76. A replacement unit can then be pressed into the empty cavity.

Obviously, many modifications and variations of the present invention are possible in light of the above teachings. It is to be understood, therefore, that the invention can be practiced otherwise than as specifically described.

What is claimed is:

1. A slide fastener comprising:

a first elongated guide member having a longitudinally extending closure edge formed of a resilient material and an opposite edge for attachment to an edge of a first flexible sheet;

a second elongated guide member having a longitudinally extending mating edge formed of a resilient material adapted for engagement with said closure edge and an opposite edge for attachment to an edge of a second flexible sheet to be attached to the first flexible sheet;

a slide member adapted to simultaneously engage and slide longitudinally along said first and second guide members and to force adjacent portions of said closure and mating edges into engagement in response thereto, said closure and mating edges comprising mutually engaging profiled surfaces adapted to provide a liquid seal between said first and second guide members;

a plurality of female coupling elements distributed along said closure edge; and a plurality of male coupling elements distributed along said mating edge and adapted to enter and latch with said female coupling elements in response to engagement of said closure and mating edges;

said male coupling elements comprising resilient latching portions that are compressed by said female coupling elements during entry thereinto and expanded into latching engagement therewith in response to complete entry thereinto, said latching portions comprising spring members having spaced apart resilient legs adapted to be forced together in response to entry into said female coupling elements, said female coupling elements defining openings with smaller dimensions than the spacing between said resilient legs, said openings being defined by cavities formed in said closure edge;

said mating edge defining a plurality of longitudinally distributed cavities and said male coupling elements comprising base portions including securing means for releasably securing said base portions within said cavities in said mating edge, whereby said male coupling elements are easily replaced.

2. A fastener according to claim 1 wherein said slide member comprises an actuator means for compressing said resilient latching portions in response to sliding movement of said slide member along said first and second guide members.

3. A fastener according to claim 2 wherein said slide member comprises an operator means for rendering said actuator means inoperative to compress said latching portions.

4. A fastener according to claim 1 including a terminal member secured to one end of one said first and second guide members and defining a receiver means for receiving an end of the other of said first and second guide members, said terminal member comprising a releasable catch means for securing said receiver means to said end of the other of said first and second guide members.

* * * * *